US005622068A

United States Patent [19]

Sjöberg

[11] Patent Number: 5,622,068

[45] Date of Patent: Apr. 22, 1997

[54] METHOD AND MACHINE FOR PRODUCING DETAILS FROM A SHEET OF METAL

[76] Inventor: Anders Sjöberg, Ågatan 56, S-334 32, Anderstorp, Sweden, SE

[21] Appl. No.: 403,741

[22] PCT Filed: Oct. 11, 1993

[86] PCT No.: PCT/SE93/00820

§ 371 Date: Mar. 13, 1995

§ 102(e) Date: Mar. 13, 1995

[87] PCT Pub. No.: WO94/08740

PCT Pub. Date: Apr. 28, 1994

[30] Foreign Application Priority Data

Oct. 12, 1992 [SE] Sweden ..... 9202982

[51] Int. Cl.[6] ..... B21D 28/04; B21D 28/20

[52] U.S. Cl. ..... 72/14.8; 72/336; 72/339; 83/36; 83/39; 83/713; 83/923; 83/76.1

[58] Field of Search ..... 72/339, 335–337, 72/330, 331, 14.8; 83/923, 39, 49, 52, 36, 50, 707, 713, 76.1

[56] References Cited

U.S. PATENT DOCUMENTS

| | | | |
|---|---|---|---|
| 2,458,538 | 1/1949 | Socke | 83/923 |
| 3,589,221 | 6/1971 | Deegan | 83/923 |
| 3,760,623 | 9/1973 | Hempelmann | 72/336 |
| 4,682,401 | 7/1987 | Tadashi et al. | 29/568 |
| 5,123,271 | 6/1992 | Sofy | 72/336 |

FOREIGN PATENT DOCUMENTS

| | | | |
|---|---|---|---|
| 63702 | 2/1914 | Austria | 83/923 |
| 177684 | 8/1902 | Germany . | |
| 264779 | 11/1910 | Germany . | |
| 508474 | 9/1930 | Germany . | |
| 511199 | 10/1930 | Germany . | |
| 602214 | 8/1934 | Germany | 83/923 |
| 883583 | 6/1953 | Germany . | |
| 934467 | 9/1955 | Germany . | |
| 3818824 | 3/1989 | Germany . | |
| 963613 | 2/1983 | U.S.S.R. | 72/330 |

*Primary Examiner*—Daniel C. Crane
*Attorney, Agent, or Firm*—Nixon & Vanderhye P.C.

[57] ABSTRACT

A method and a machine for producing plate components (1) from a sheet of metal (2) which is moved through a press (13) for at least a first cutting operation to be performed to separate the plate components from the sheet of metal and a second cutting operation to separate scrap (27), said press being open with a space (32) allowing free insertion of the metal sheet. According to the invention the metal sheet is displaced by means of a feeding device (11) between the metal working operations, following a predetermined coordinate pattern and being machined in consecutive y-sections (24, 26) each y-section (24) being fully machined in x-direction before the immediately following y-section (26) is brought into position for machining, the metal sheet being machined within surface areas (33), each of which has a length in x-direction of at most 30 cm, and is larger than the plate component so that a peripheral, unbroken scrap portion (27) remains after the first cutting operation. The second cutting operation is performed to sever a scrap portion (27) by cutting at an angle so that a trimmed side edge (28) is formed and at the same time a trimmed edge (35) across the y-section (24). Furthermore, displacement of the metal sheet is controlled by a programmable control unit which also controls the movements of the metal working tools as desired.

20 Claims, 5 Drawing Sheets

METHOD AND MACHINE FOR PRODUCING DETAILS FROM A SHEET OF METAL

This application is a 371 of PCT/SE93/00820, filed Oct. 11, 1993.

The present invention relates to a method of producing plate components of varying size and shape from a flat sheet of metal having a thickness of from 0.1 to 20 mm which is displaced stepwise in its plane through at least one press for at least two metal working operations to be performed comprising a first cutting operation to separate the plate components from the sheet of metal, and a second cutting operation, separate from the first cutting operation, to remove scrap formed at the first cutting operation, said press being of the type having an upper tool stand for first parts of at least two metal working tools for said two metal working operations, and a lower tool stand for other complementary parts of each metal working tool so that the upper and lower tool stands define a space between them for free insertion of the metal sheet in its direction of feed, said space having a depth in horizontal direction that is Greater than the dimension of one plate component measured perpendicular to said direction of feed, the metal sheet having an original dimension perpendicular to said direction of feed that is several times greater than the plate component measured in the same direction. The invention also relates to a sheet metal working machine for producing plate components of varying size and shape from a flat sheet of metal having a thickness of from 0.1 to 20 mm, comprising at least one press having an upper tool stand for first parts of at least two metal working tools and a lower tool stand for other complementary parts of each metal working tool, these tool stands defining a space between them for free insertion of the metal sheet in its direction of feed, said space having a depth in horizontal direction that is greater than the dimension of one plate component measured perpendicular to said direction of feed, the metal sheet having an original dimension perpendicular to said direction of feed that is several times greater than the plate component measured in the same direction, which metal working tools are arranged to perform first and second cutting operations to separate the plate components from the metal sheet or to separate scrap, the machine also comprising a feeding device with gripping means to firmly retain the metal sheet and to move it stepwise in relation to the press, and a horizontal table located in a plane with the upper surface of the lower tool stand containing said other complementary tool parts.

Plate components are usually produced from a continuous metal strip which is supplied from a coil to a punching machine by means of a roller feeder located immediately before the punching machine. The width of the metal strip is selected depending on the size of the plate components to be produced, in order to reduce waste in the sheet metal remaining after the components have been punched out. This method is used primarily when large series of components of the same type are to be cut. However, it is unsuitable for smaller series of identical plate components since for reasons of cost and space a large assortment of coils of metal strip of different widths cannot be maintained and a coil of metal strip of the desired width for a particular plate component may not be available at the time the client places his order. The described method using metal strip on coils thus means that the price per unit becomes too high for small series and sometimes even for medium-sized series of identical plate components, or different plate components with similar dimension except for the wall thickness in the initial work operation. Two different techniques are used in order to reduce the unit price for small and medium-sized series of plate components, both of which start with plate in the form of a rectangular sheet of standard format, known as "cut-to-size sheet metal". According to one of these techniques the cut-to-size sheet is cut into a plurality of identical rectangular strips, the width of which adapted to the relevant plate component. After this extra work phase, which requires separate equipment, the metal strips are usually transferred to the conventional punching machine used for machining said continuous metal strip. The metal strips are fed into the punching machine by said roller feeder. The other technique is based on nibbling. The cut-to-size sheet metal is moved gradually through a nibbling machine with a nibbling tool that cuts through the cut-to-size plate with small cutting movements in rapid succession along a predetermined curve in order to form blanks of plate components. Two or more small bridging sections remain uncut so that the plate component blank remains attached to the nibbled plate. This is then transferred to a device for removing the plate component blanks from the coherent scrap portion of the cut-to-size plate remaining, the bridging sections being destroyed by being cut away, for instance. It is difficult at this stage to align and stack the plate component blanks for further machining. Furthermore, in order to achieve the finished plate component in a machine with single-tool, the tool must be changed after each metal working operation a number of times, depending on the shape of the plate component.

The two techniques described, starting from cut-to-size sheet metal, are not rational since they are complicated to perform and require extra equipment. These deficiencies and drawbacks result in the price per unit being unacceptably high.

The object of the present invention is to achieve an improved method and metal working machine that essentially reduce the above-mentioned problems and enable the production of plate components or blanks therefor in a simple way and at an acceptable unit price.

The method according to the invention is characterized in that the metal sheet is displaced stepwise between the metal working operations following a predetermined coordinate pattern the x-axis of which coincides with the direction of feed of the metal sheet through the press; that the metal sheet is machined in consecutive y-sections extending in x-direction between the front and rear ends of the metal sheet and defined by a free side edge of the metal sheet and an imaginary line parallel to the side edge and said x-axis; that one y-section is fully machined by stepwise displacement of the metal sheet in x-direction before the next y-section is brought into position for machining, the metal sheet being machined within identical consecutive parallelogram-shaped surface areas, each of which has a length in x-direction of at most 30 cm, and is larger than the plate component so that a peripheral, unbroken scrap portion remains after the first cutting operation; that the second cutting operation is performed to sever one such unbroken scrap portion, or at most three unbroken scrap portions of a surface area or of at most three consecutive surface areas, respectively, provided the two or three surface areas together have a length of at most 30 cm; that said scrap severance is performed by cutting at an angle by said second cutting operation so that a trimmed side edge is gradually formed along said imaginary line and at the same time a trimmed edge fitting the first edge is formed across the y-section; that, after one y-section has been completely removed, the metal sheet is stepwise displaced in y-direction a distance corresponding to the width of a y-section so that an immediately following y-section is aligned with the press, and at a chosen time between the moment when the metal sheet leaves the press and the moment when it is returned in the opposite direction to its direction of feed, to its initial position upstream of the press; and that the displacement of the metal sheet is controlled by a freely progammable control unit which also controls the movements of the metal working tools either synchronously or asynchronously with each other, as desired.

The metal working machine according to the invention is characterized in that the feeding device is provided with an actuator for stepwise displacement of the metal sheet in relation to and through the press following a predetermined coordinate pattern, the x-axis of which coincides with the direction of feed of the metal sheet through the press; that said metal working tool for the second cutting operation for scrap severance is designed and arranged to cut at an angle so that a trimmed side edge is formed along an imaginary line located parallel to the direction of feed of the metal sheet and at the same time a trimmed edge fitting the first side edge is formed across the y-section within which metal components are produced; and that the metal working machine includes a freely progammable control unit arranged to control displacement of the metal sheet in accordance with said coordinate pattern and to control the movements of the metal working tools either synchronously or asynchronously with each other, as desired.

The invention will be described in more detail in the following, with reference to the accompanying drawings.

Figure 1:
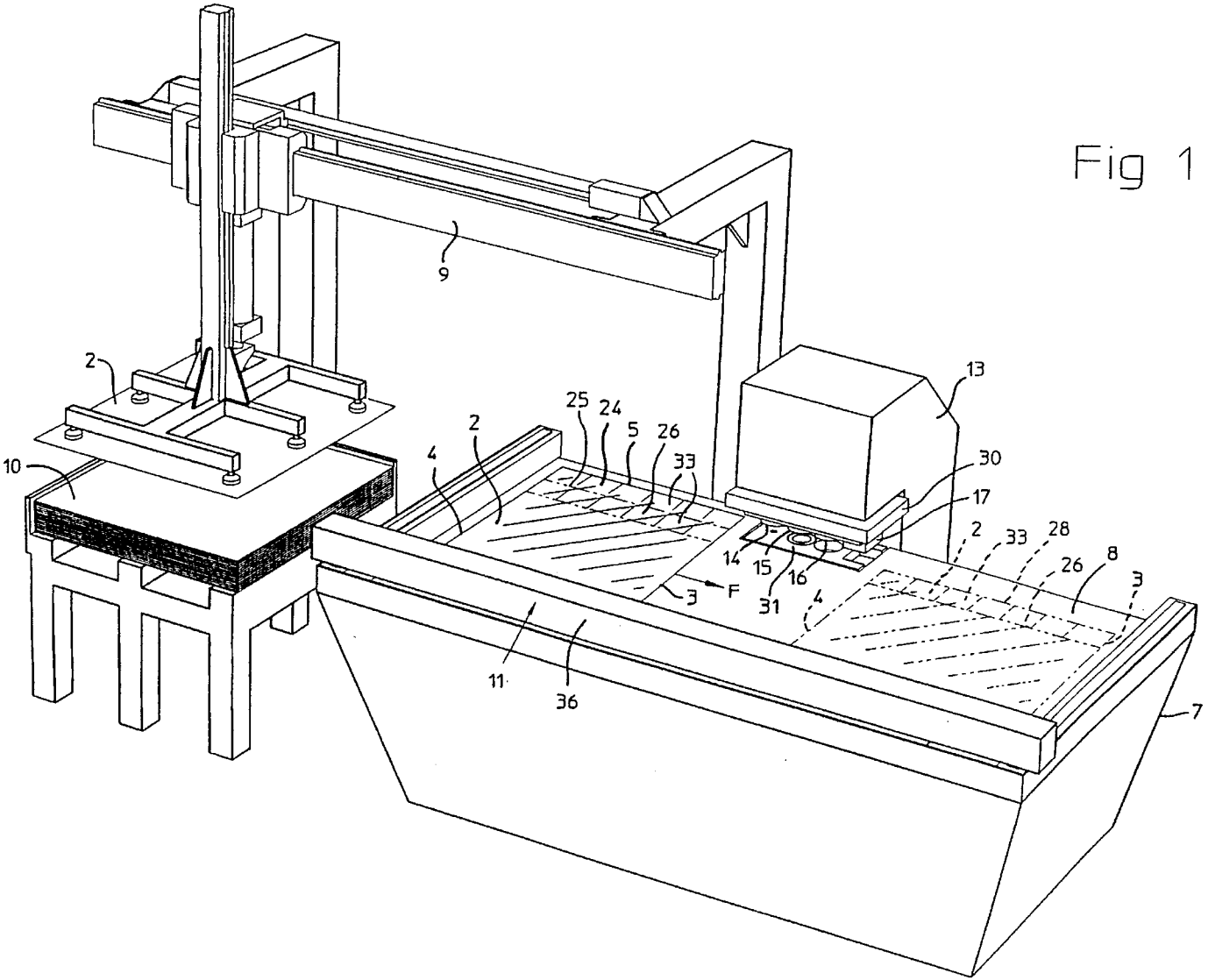
FIG. 1 is a perspective view of a metal working machine according to a first embodiment of the invention.
Figure 2:
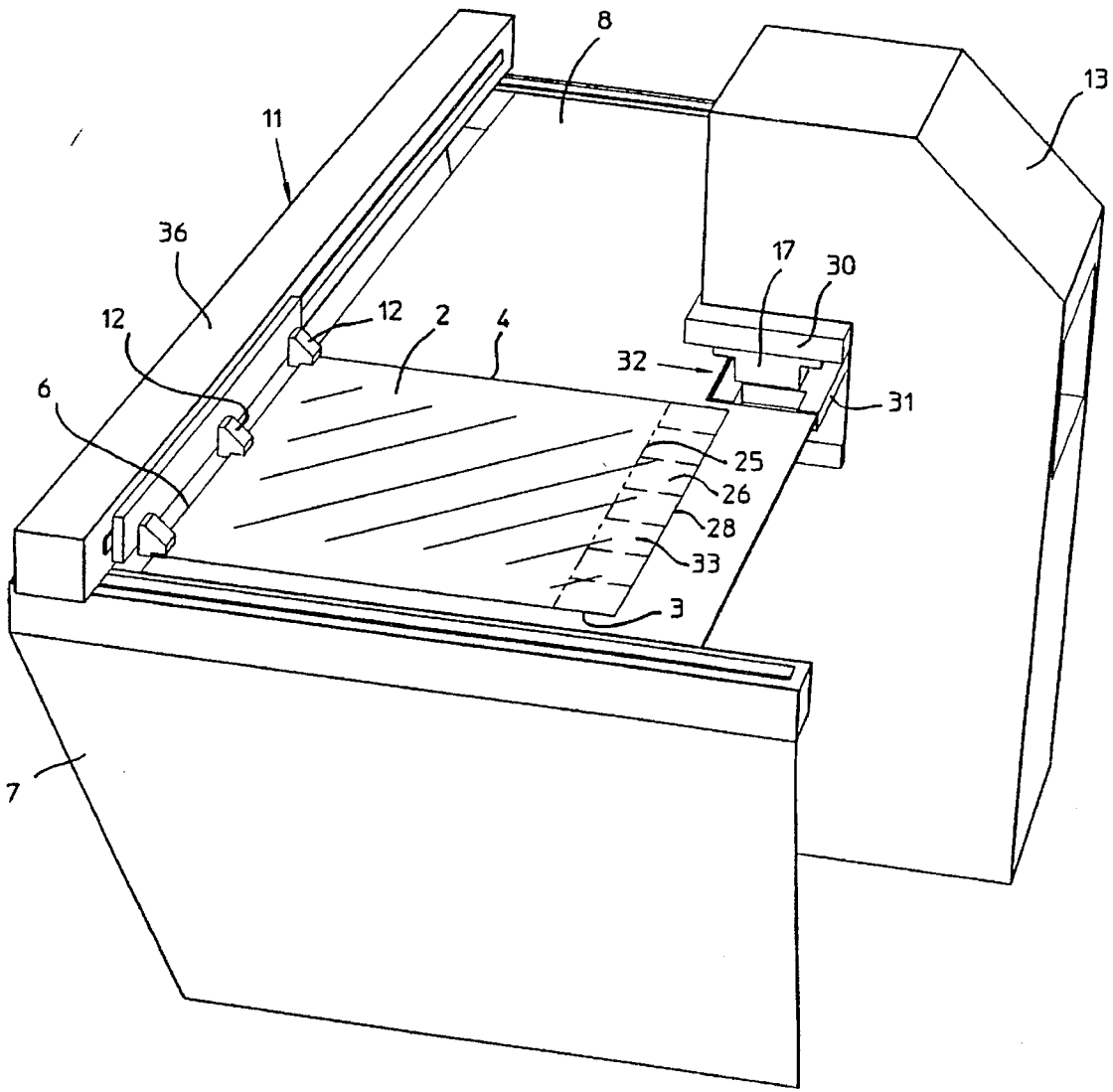
FIG. 2 is a view in a different perspective of the metal working machine according to FIG. 1.
Figure 5:
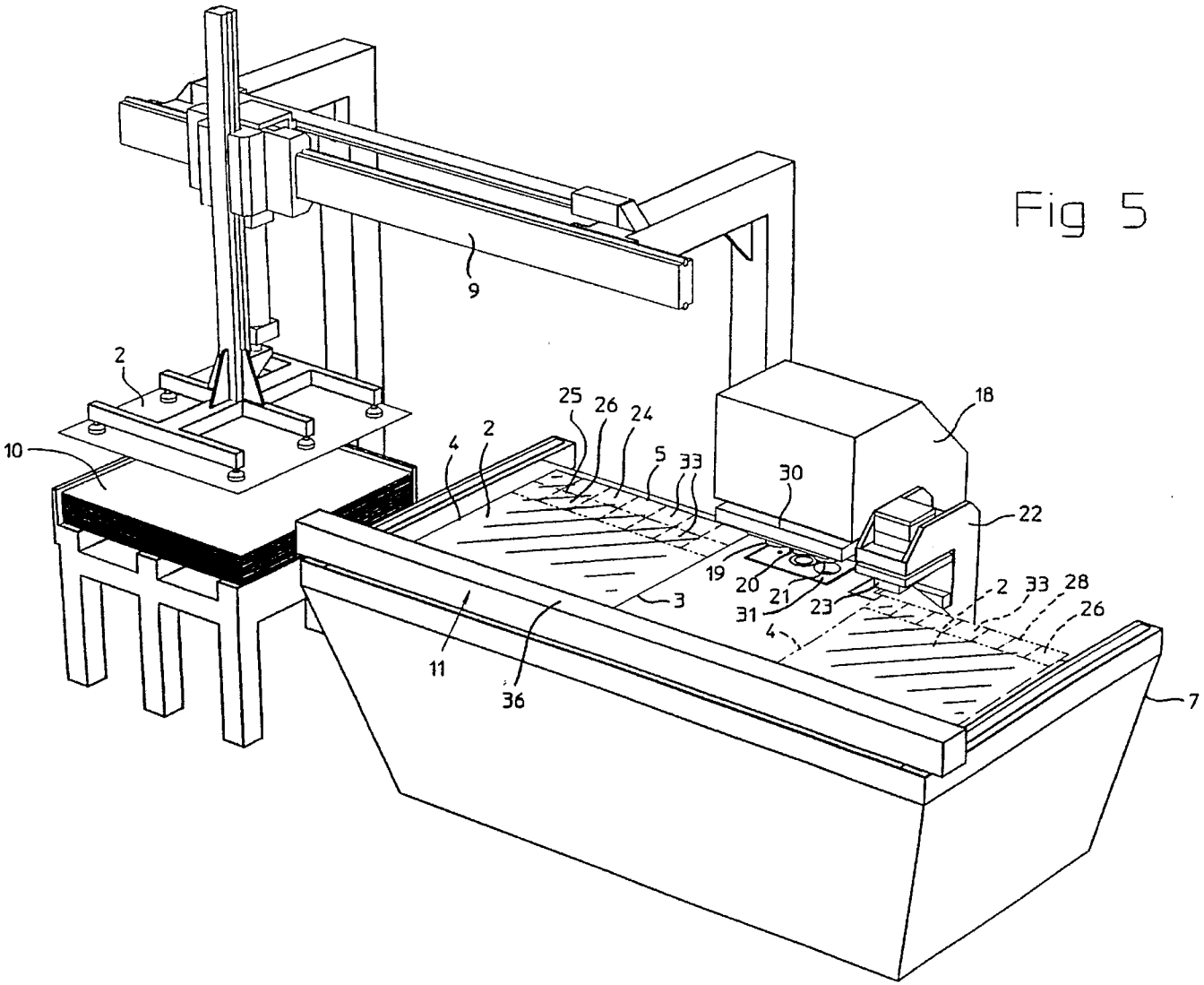
FIG. 5 shows in perspective a metal working machine according to a second embodiment of the invention.

FIGS. 1 and 2 show schematically a metal working machine for producing plate components 1 from a flat, rectangular metal sheet 2 which, seen in its direction of feed F, is defined by a transverse front end edge 3, a transverse rear end edge 4, a longitudinally running first side edge 5 and a longitudinally running second side edge 6 (see FIG. 2). The metal working machine comprises a stand 7 supporting an oblong table 8 with a horizontal surface on which the metal sheet 2 rests and is displaced stepwise in its plane parallel with the longitudinal direction of the table, first forwards for machining, and then returning along the table 8 without leaving it, to be set in a new position for machining. The metal working machine comprises lifting and travelling equipment 9 for transferring the metal sheets 2 from a stack 10 to the table 8. It is also provided with a feeding device 11 with an actuator 36 for forced displacement of the metal sheet 2 in its plane on the table. The feeding device 11 has a plurality of gripping devices 12 to firmly retain the metal sheet 2. The metal working machine shown in FIG. 1 is provided with a press 13 located close to and inside one long side of the table, the press having four metal working tools 14, 15, 16, 17, whereas the metal working machine according to FIG. 5 is provided with a first press 18 with three metal working tools 19, 20, 21, and a second press 22 with a special metal working tool 23 consisting of a tool cutting at an angle for trimming the metal sheet after the plate components have been removed. The press is of the open type, generally having an upper tool stand 30 for first parts of at least two metal working tools and a lower tool stand 31 for other, complementary parts of the metal working tools so that the upper and lower tool stands 30, 31 define a space 32 between them (see FIG. 2) for free insertion of the metal sheet 2 in its direction of feed F. Such a press is sometimes called a C-press. The depth of the space 32 in horizontal direction is greater than the dimension of a plate component 1 measured perpendicularly to said direction of feed F, the metal sheet 2 having an original dimension perpendicular to said direction of feed, that is several times greater than the plate component 1 measured in the same dimension.

Figure 3:
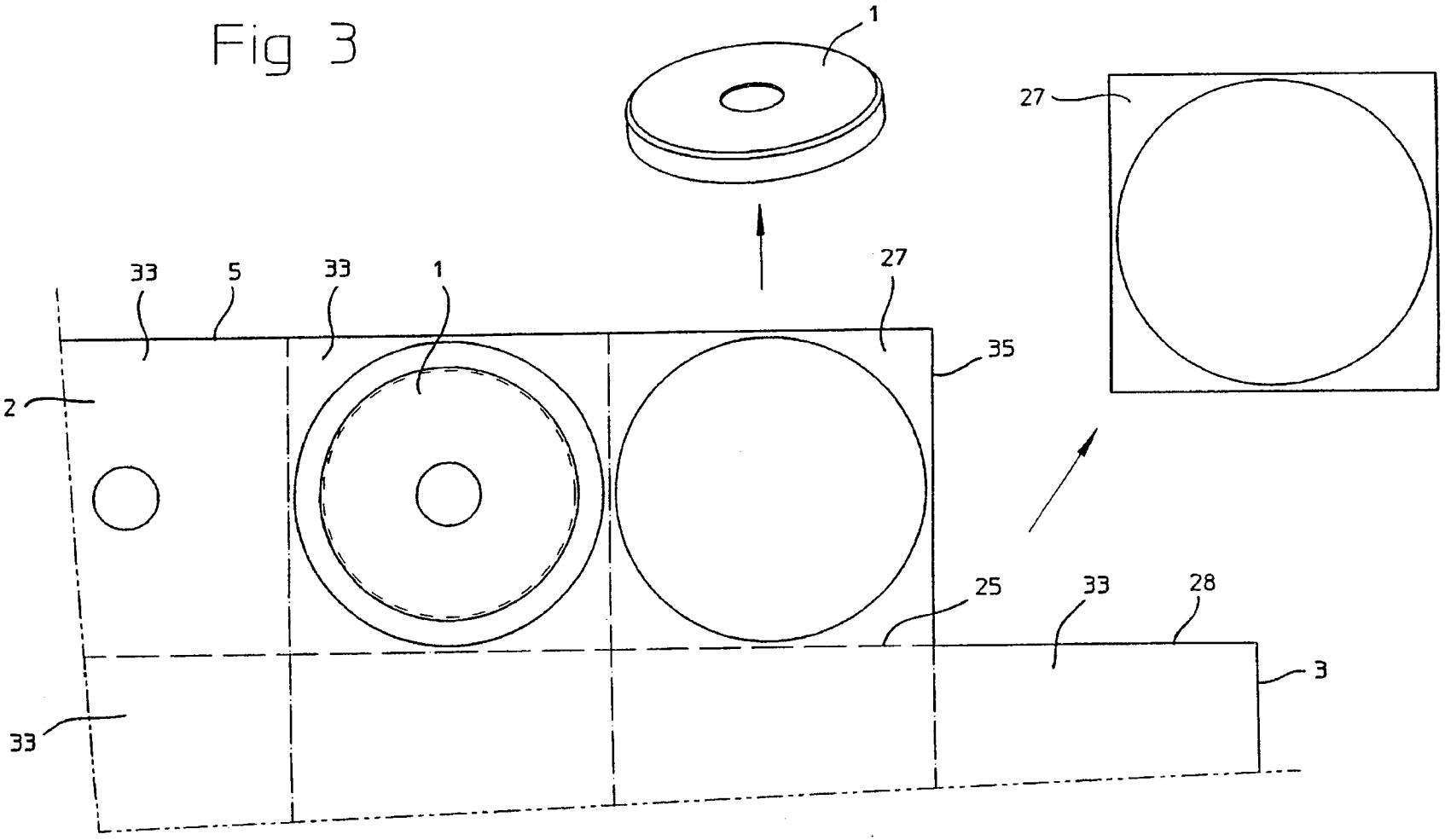
FIG. 3 is a view of a part of a metal sheet which has been partially machined in order to produce bowl-shaped washers.
Figure 4:
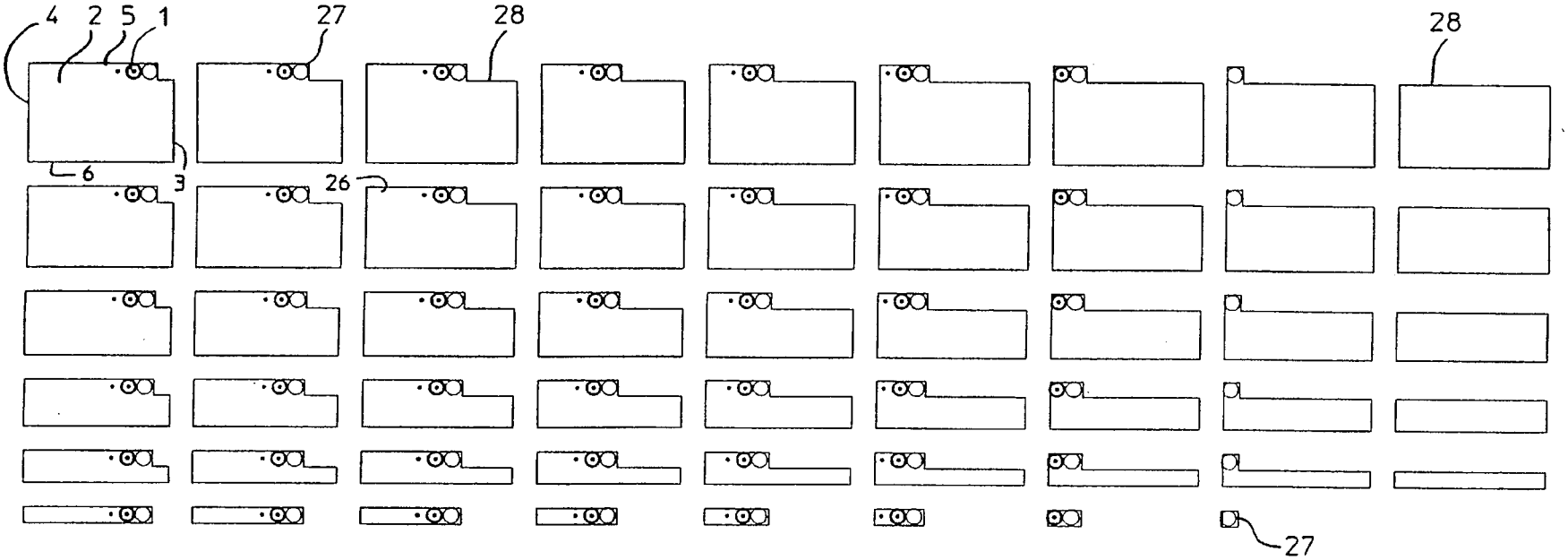
FIG. 4 illustrates how the metal sheet decreases as it passes through the machine shown in FIG. 1.

The feeding device 11 for displacement of the metal sheet 2 is arranged to move the sheet 2 in accordance with a predetermined coordinate pattern, the x-axis of which coincides with the direction of feed F of the metal sheet 2 through the press, the feeding device 11 being controlled by signals from a control unit (not shown). The latter also controls connection and disconnection of said metal working tools either synchronously or asynchronously. The control unit is pre-programmed by the operator, depending on the shape of the plate components 1 to be produced. The metal sheet 2 is aligned by the feeding device 11 so that a first outer y-section 24 thereof is situated in front of the first metal working tool 14. This outer y-section is defined by the front and rear end edges 3, 4, one or first side edge 5 and the imaginary border line 25 parallel to this side edge, from the following inner, second y-section 26. The metal sheet 2 is fed forward stepwise in x-direction and stops in the press/presses (FIG. 1/FIG. 5) in which the metal working operations are to be performed as predetermined by choice of metal working tools. The entire outer first y-section 24 is machined in this manner, as illustrated in FIG. 4. To enable machining of the next, i.e. the second y-section 26, the metal sheet 2 is displaced a corresponding distance in y-direction so that it is again aligned with the metal working tools. This displacement in y-direction may take place before or after the metal sheet 2 has been returned in a direction opposite to the direction of feed F to a starting position before the press, or during this return movement. The displacement one step in y-direction to align each following y-section 26 preferably occurs after the metal sheet 2 has been returned to a starting position before the press. One y-section 24 is thus fully machined by stepwise displacement of the metal sheet 2 in x-direction, before the next y-section 26 is brought into position for machining, the metal sheet 2 thus being machined within identical, consecutive parallelogram-shaped surface areas 33, each having a maximum length of 30 cm in x-direction and being larger than the plate component 1, so that a circumferentially unbroken scrap portion 27 (see FIG. 3) is left when the plate component 1 has been removed. A subsequent cutting operation is then performed after full step feeding, in order to remove an unbroken scrap portion 27 or at most three coherent unbroken scrap portions 27 of one surface area 33 or at most three consecutive surface areas 33 provided the length of the two or three surface areas 33 is maximally 30 cm. In the embodiment shown the surface areas 33 are quadratic. This trimming of the metal sheet 2 is preferably performed continuously as each plate component 1 is removed from the metal sheet 2. Finally a completely new, straight (linear), outer, trimmed side edge 28 is obtained in the metal sheet 2 which has decreased in size by one y-section 24. The cutting tool 17; 23 for trimming the metal sheet is provided with an angular cutter to enable simultaneous cutting in two directions. Scrap severance is thus performed by means of angular cutting so that a straight, trimmed side edge 28 is gradually formed along said imaginary border line 25, and at the same time a straight (linear) trimmed edge 35 across the y-section 24. In the case shown the edge 35 is perpendicular to the side edge 28. The angular cutting may alternatively be performed so that the edge 35 is inclined forwards or backwards depending on the shape (contour) of the plate component.

The press according to FIG. 1 has a combined sequence tool or multi-station tool, in which three different part-operations are performed individually one after the other in order to produce a plate component 1, the metal sheet 2 thus being fed one step forward for each part-operation. The first tool 14 makes a hole in the metal sheet, while the second tool 15 in the sequence performs cutting and pressing of a surface area 33, in which a hole was made in the preceding step, in order to produce a finished plate component 1 in the form of a washer. The third tool 16 removes a previously completed washer 1 which is then stacked in a box or the like below. The combined sequence tool is also provided with a fourth tool 17 for trimming the metal sheet 2 at an angle as described previously, so that the scrap portion 27 of each surface area 33 is cut away in the form of a complete, flat piece as illustrated in FIG. 3.

In the metal working machine shown in FIG. 5 the first press 18 is provided with a combined sequence tool in which three different part-operations are performed in the manner described above, and the cutting tool 23 for trimming the metal sheet 2 is arranged in the separate, second press 22. This press is suitably synchronized with the first press 18.

The metal working machine is universal in that, with the aid of various tool appliances, it is able to perform a plurality of metal working operations depending on which plate component is to be produced. Besides cutting (punching), these operations may include one or more of the following: drawing, embossing, bending, pressing, drilling and screw threading. The metal working machine may also be provided with extra equipment such as welding equipment, riveting unit, nibbling unit, etc.

The presses may be operated pneumatically, hydraulically or mechanically (eccentrically).

Complete tools, single-station tools or combined tools may be used as well as sequence tools.

The metal working machine according to the invention can advantageously use the same tools as are used in conventional punching machines for coiled metal strip. It is then a simple matter to move the tool from one machine to the other for larger or smaller series. The new metal working machine can also be used with advantage for pre-treated metal sheets, such as painted sheets, sheet coated with plastic or having text or instructions printed on them, etc.

The metal sheets shown and described above are rectangular in shape, which is normal. However, the invention may of course be used for metal sheets of any other shape. Essential is that the metal sheet is retained by a feeding device that displaces the metal sheet in a coordinate pattern of the type specified, where the abscissa corresponds to the direction of feed F of the metal sheet through the press.

As mentioned, the metal sheet has an original width several times greater than the width of the plate component measured perpendicular to the direction of feed F. The original width of the metal sheet is suitably at least 3 times, perferably 4 times greater than the width of the plate component to be produced.

The invention enables the production of plate components of arbitrary, i.e. varying size and shape, in a simple manner and at an acceptable price per unit. The size of the plate component is limited only by the depth of the press selected, measured in the plane of the metal sheet. All metal working operations and displacements of the metal sheet are programmed as desired with regard to various periods of time, starting from a reference position for the metal sheet resting on the table near the press and in position for a first feed step. The scrap pieces formed are easier to handle since they are flat and peripherally unbroken and therefore take up less volume.

I claim:

1. A method of producing plate components from a flat sheet of metal having a thickness of from 0.1 to 20 mm using a press with at least first and second working tools, the plate being larger than at least three plate components; each plate component having a length along an x-axis of the press and a width along a y-axis of the press, and the plate having first and second longitudinal edges, substantially parallel to the x-axis and each other, and first and second transverse edges substantially parallel to the y-axis and each other; said method comprising the steps of automatically and substantially sequentially:

(a) feeding the plate into operative association with the press so that a first corner of the plate at the intersection of the first longitudinal and transverse edges is aligned with the first metal working tool;

(b) acting on the plate at the first corner with the first cutting tool to at least partially form or separate a metal component from the plate at the first corner and so that a continuous piece of scrap metal is formed; then (c) incrementally moving the plate in the x-direction so that the first corner is advanced into operative association with the second metal working tool; then (d) with the second cutting tool removing the scrap, with a maximum dimension along the x-axis of 30 mm, from the plate while forming a third longitudinal edge substantially parallel to the x-axis and a third transverse edge substantially parallel to the y-axis, forming a new first corner at the intersection of the first longitudinal edge and third transverse edge;

(e) repeating steps (a)–(d) to elongate the third longitudinal edge until all the metal components between the first and third longitudinal edges have been removed; then (f) moving the metal plate in the y-direction the width of the next metal component to be formed and moving the metal plate in the x-direction approximately the length of the metal plate so that a new corner thereof is positioned approximately at the position of the first corner in step (a); and (g) repeating steps (a)–(e), and step (f) if necessary, until all desired components have been formed from the metal plate.

2. A method as recited in claim 1 wherein steps (a)–(c) are repeated once or twice before step (d) is practiced.

3. A method as recited in claim 2 wherein steps (a)–(c) are repeated twice before step (d) is practiced.

4. A method as recited in claim 1 wherein the press has a third metal working tool between the first and second tools along the x-axis; and comprising the further steps between steps (b) and (c), of: (h) incrementally moving the plate so that the first corner is aligned with the third metal working tool, and then (i) acting on the plate with the third metal working tool to at least partially form or separate a metal component in the plate; and wherein steps (h) and (i) are repeated when steps (b) and (c) are repeated.

5. A method as recited in claim 4 wherein steps (b) and (i) are practiced to completely form and separate each metal component from the metal plate.

6. A method as recited in claim 4 wherein steps (b) and (i) are practiced to form substantially circular metal components, and step (d) is practiced to substantially simultaneously cut the third longitudinal and transverse edges.

7. A method as recited in claim 1 wherein steps (a)–(g) are practiced under the control of a programmable controller.

8. A method as recited in claim 4 wherein the press has a fourth metal working tool between the third and second tools; and comprising the further steps, between steps (i) and (c), of: (j) incrementally moving the plate so that the first corner is aligned with the fourth metal working tool, and then (k) acting on the plate with the fourth metal working tool to at least partially form or separate a metal component; and wherein steps (j) and (k) are repeated when steps (h) and (i) are repeated.

9. A method as recited in claim 8 wherein steps (b), (i) and (k) are practiced to completely form and separate each metal component from the plate.

10. A method as recited in claim 9 wherein steps (b), (i), and (k) are each practiced to effect at least one of cutting, bending, pressing, drawing, embossing, drilling, or screw-threading.

11. A method as recited in claim 1 wherein the press has a third metal working tool between the first and second tools along the x-axis; and comprising the further steps between steps (b) and (c), of: (h) incrementally moving the plate so that the first corner is aligned with the third metal working tool, and then (i) acting on the plate with the third metal working tool to at least partially form or separate a metal component in the plate; and wherein steps (h) and (i) are repeated when steps (b) and (c) are repeated.

12. A method as recited in claim 11 wherein the press has a fourth metal working tool between the third and second tools; and comprising the further steps, between steps (i) and (c), of: (j) incrementally moving the plate so that the first corner is aligned with the fourth metal working tool, and then (k) acting on the plate with the fourth metal working tool to at least partially form or separate a metal component; and wherein steps (j) and (k) are repeated when steps (h) and (i) are repeated.

13. A method as recited in claim 1 wherein steps (a)–(g) are practiced to produce all the metal components of the same size and configuration.

14. A method as recited in claim 1 wherein steps (b) and (d) are practiced to work on the metal plate synchronously.

15. A method as recited in claim 1 wherein steps (b) and (d) are practiced to work on the metal plate asynchronously.

16. A sheet metal working machine comprising:

an upper tool stand having at least first and second different metal working tool components;

a lower tool stand having at least first and second metal working tool components complementary to said upper tool stand tool components, to form first and second metal working tools;

said tool components of said upper and lower tool stands spaced from each other a first distance, which is greater than the thickness of sheet metal to be acted upon thereby;

feeding means for feeding sheet metal between and into alignment with, and way from, said upper and lower tool stands in an incremental manner along both x and y axes;

said first tool components spaced from said second tool components along said x-axis;

said second tool components defining a cutting tool having first and second substantially right angled portions parallel to said x and y axes, respectively, said first portion having a maximum working length along the x-axis of 30 cm; and a programmable controller for automatically controlling operation of said feeding means and first and second tools to form at least four metal components from a piece of sheet metal, said programmable controller comprising means for controlling said feeding means to move a piece of sheet metal in increments equal to the length of each metal component formed in said x-axis, in operative association with said tools, and after an x-axis elongated strip has been separated from the piece of sheet metal incrementally moving the piece of sheet metal the appropriate width of one metal component in the y-axis, and the approximate length of the piece of sheet metal in the x-axis.

17. A machine as recited in claim 16 wherein said first tool is in a first press, and said second tool in a second press spaced from said first press along said x-axis.

18. A machine as recited in claim 16 further comprising third and fourth tools between said first and second tools along said x-axis.

19. A machine as recited in claim 18 wherein said first, third, and fourth tools each comprise bending, pressing, drawing, embossing, cutting, or screw threading tools.

20. A machine as recited in claim 17 further comprising third and fourth tools between said first and second tools along said x-axis, said first, third, and fourth tools each comprising bending, pressing, drawing, embossing, cutting, or screw threading tools.

* * * * *